US007436391B2

(12) United States Patent
Bilger et al.

(10) Patent No.: US 7,436,391 B2
(45) Date of Patent: Oct. 14, 2008

(54) NAVIGATION SWITCH

(75) Inventors: Markus Bilger, Trossingen (DE); Jürgen Götz, Villingen-Schwenningen (DE); Thomas Riester, Villingen-Schwenningen (DE); Michael Steiert, Villingen-Schwenningen (DE)

(73) Assignee: Siemens Aktiengesellschaft, Munich (DE)

( * ) Notice: Subject to any disclaimer, the term of this patent is extended or adjusted under 35 U.S.C. 154(b) by 530 days.

(21) Appl. No.: 11/097,221

(22) Filed: Apr. 4, 2005

(65) Prior Publication Data

US 2005/0168440 A1 Aug. 4, 2005

Related U.S. Application Data

(63) Continuation of application No. PCT/DE03/03120, filed on Sep. 19, 2003.

(30) Foreign Application Priority Data

Oct. 9, 2002 (DE) ..... 102 47 093

(51) Int. Cl.
*G09G 5/00* (2006.01)

(52) U.S. Cl. ..... 345/156; 345/157; 345/161; 200/5 A; 200/6 A; 200/5 R; 200/18

(58) Field of Classification Search ..... 345/156, 345/157, 161
See application file for complete search history.

(56) References Cited

U.S. PATENT DOCUMENTS 4,349,708 A 9/1982 Asher
4,992,631 A * 2/1991 Gee ..... 200/5 A
5,498,843 A * 3/1996 Date et al. ..... 200/6 A
5,821,482 A 10/1998 Ootani et al.
6,580,039 B2 * 6/2003 Nakade et al. ..... 200/6 A
6,586,689 B2 * 7/2003 Kuriyama ..... 200/6 A

FOREIGN PATENT DOCUMENTS

| | | |
|---|---|---|
| DE | 43 26 312 A1 | 2/1995 |
| DE | 44 43 726 C2 | 6/1995 |
| DE | 200 01 869 U1 | 7/2000 |
| DE | 100 05 027 A1 | 8/2001 |
| EP | 0 422 361 B1 | 4/1991 |
| EP | 0 558 239 A1 | 9/1992 |

(Continued)

OTHER PUBLICATIONS

Derwent Abstract DE-44 43 726 C2; Multidirectional input switch has movable conductive element in housing and caused to contact fixed contact areas by moving operating lever, Jun. 14, 199.

(Continued)

*Primary Examiner*—Richard Hjerpe
*Assistant Examiner*—Jennifer T Nguyen
(74) *Attorney, Agent, or Firm*—Bell, Boyd & Lloyd LLP

(57) ABSTRACT

The present invention relates to a navigational button including an actuating element which is displaceable at least in two directions and controls the navigation button. The present actuating element is arranged in a casing and performs an action on a communication element. A limitation element is disposed between the actuating element and the casing in such a way that it limits actuation efforts performed on the navigational button.

10 Claims, 5 Drawing Sheets

FOREIGN PATENT DOCUMENTS

| | | | |
|---|---|---|---|
| EP | 0 817 226 | A2 | 1/1998 |
| EP | 1 262 853 | A1 | 12/2002 |
| JP | 09288930 | A | 11/1997 |
| JP | 2000340065 | A | 12/2000 |
| JP | 2002260492 | A | 9/2002 |

OTHER PUBLICATIONS

Derwent Abstract EP-817 226 A2; Rocker type electrical switch e.g. for tape recorders has rocker operating an actuator pad with elastic arms that operate contacts, 01/07199.

Derwent Abstract DE-200 01 869 U1; Switch actuating mechanism with a rocker switch such as for automatic adjustment of a car mirror, comprises tilt switch with spring plate axially supported on bearing for providing spring force, Jun. 21, 2000.

Derwent Abstract DE-43 26 312 A1 ; Electromechanical rocker type switch has movable contact on pivot-mounted carrier having shaped guide track for follower plunger of rocker, Feb. 9, 1995.

* cited by examiner

FIG 1
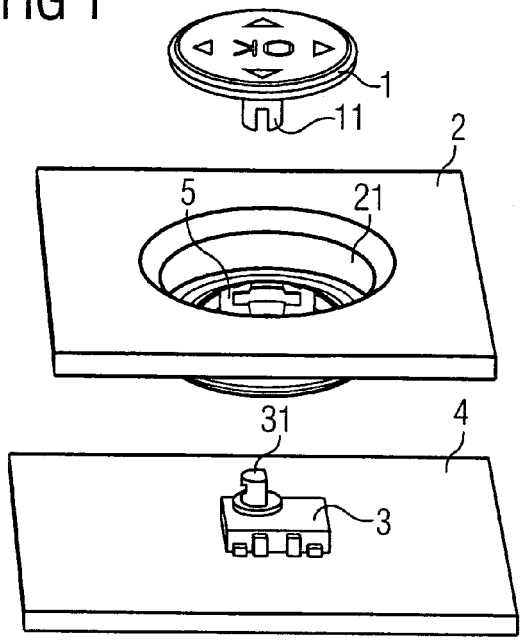
FIG 2
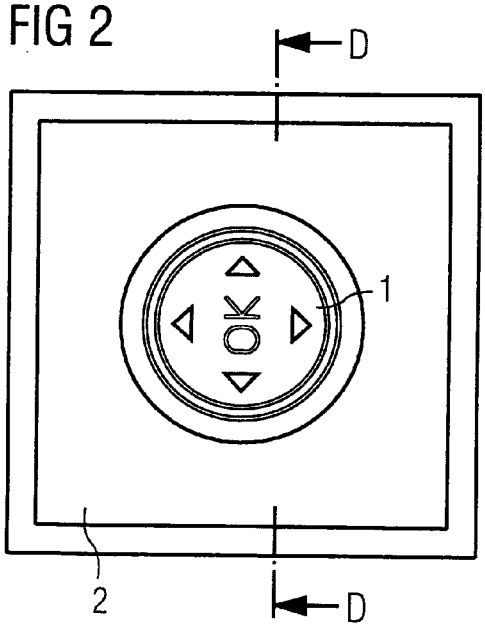
FIG 3 D - D
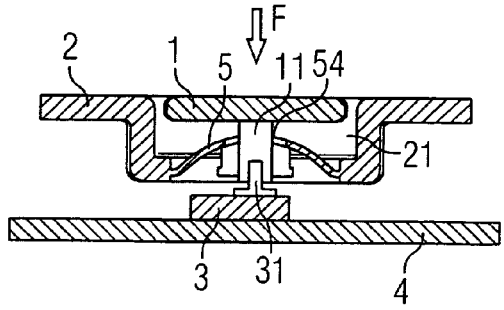

FIG 4
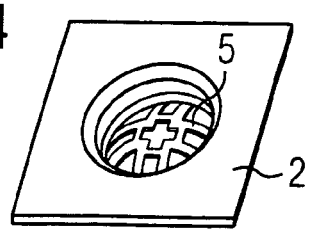
FIG 5
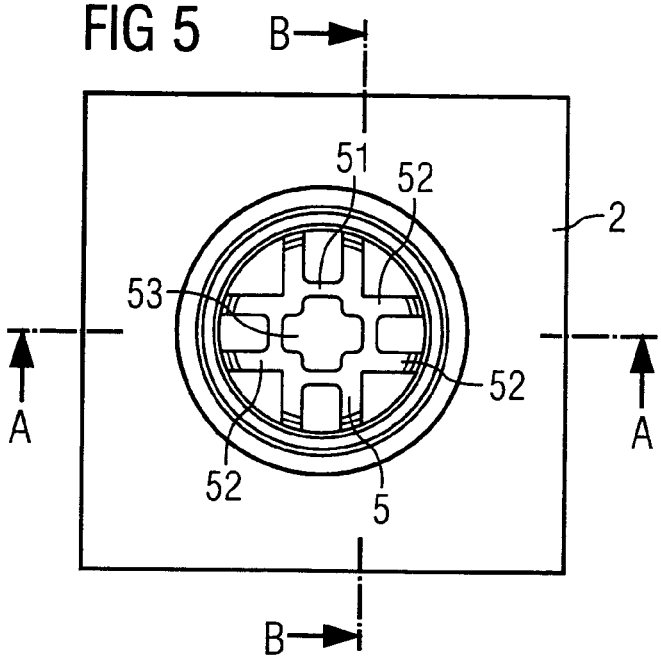
FIG 6 A - A
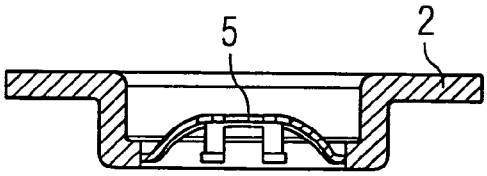
FIG 7 B - B
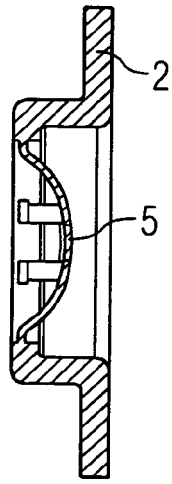

FIG 10 C - C
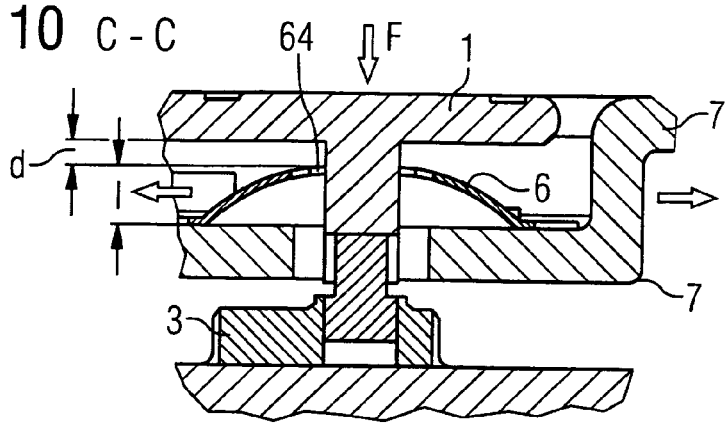
FIG 11
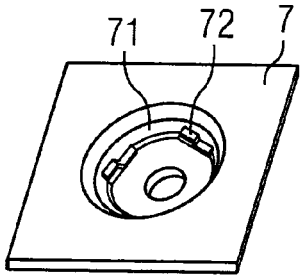
FIG 12
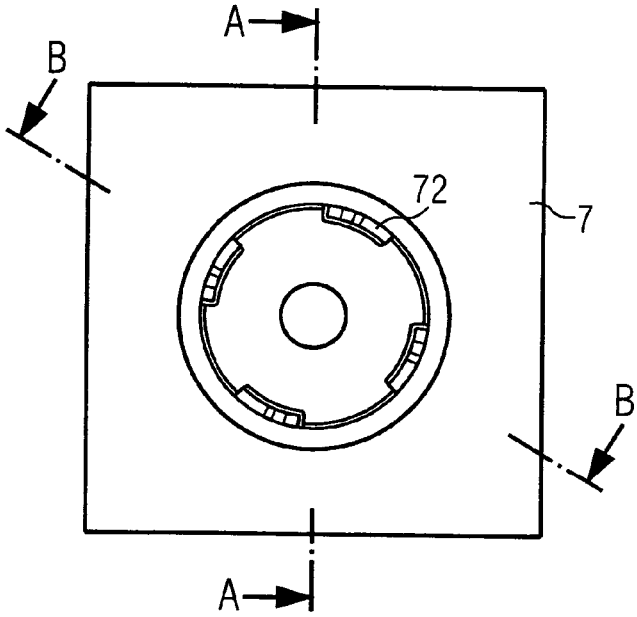
FIG 13 A - A
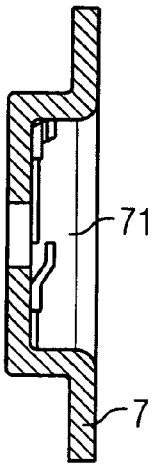
FIG 14 B - B
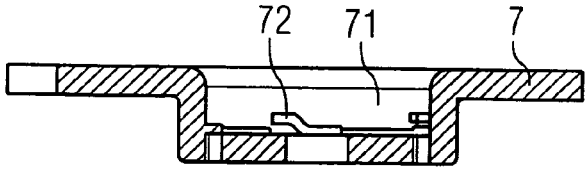

FIG 15
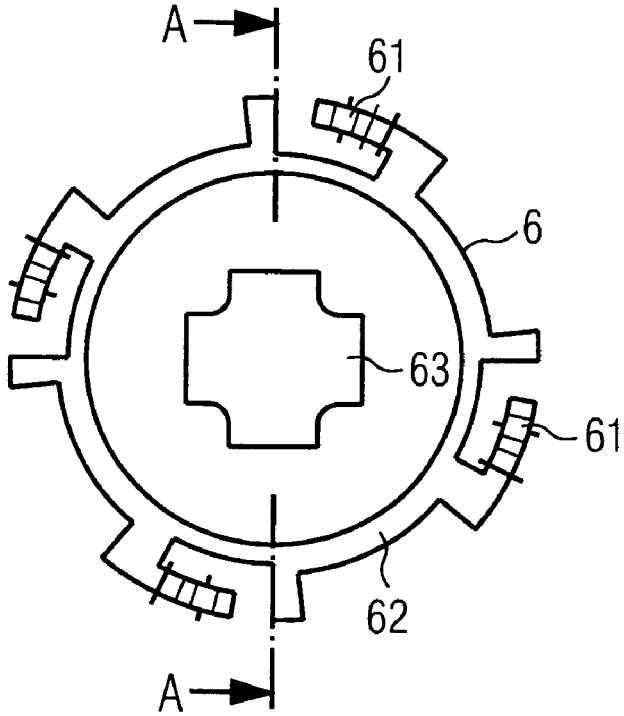
FIG 16 A - A
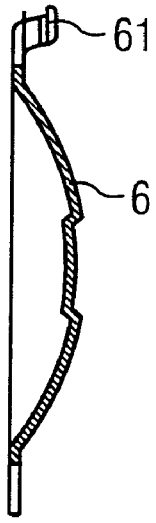
FIG 17
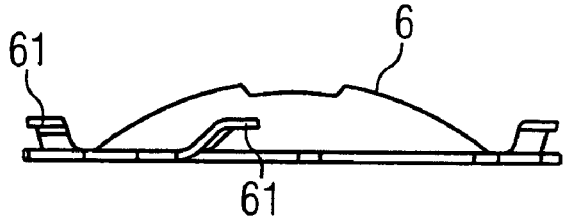

NAVIGATION SWITCH

CROSS REFERENCE TO RELATED APPLICATIONS

The present application is a continuation of International Application Serial Number PCT/DE03/03120, filed Sep. 19, 2003, which designated the United States and further claims priority to German patent application 10247093.6, filed Sep. 10, 2002, the both of which are herein incorporated by reference.

BACKGROUND OF THE INVENTION

The invention relates to a navigation switch having an operating element which can be tilted in at least two directions and which can be used to operate the navigation switch, a housing holding the operating element and a switching element on which the operating element acts.

Navigation switches normally have a switching housing with a switching element arranged in the interior of the switching housing, said switching element being able to be moved against at least two contact regions and, when moved, reaching a contact position which switches an electrical contact. The switching element has an operating arm routed to the exterior as an axial extension to a switching lever arranged in the interior of the housing. The operating arm can be pivoted in a plurality of directions from a central position of rest using a control element which is located in a switching housing.

Such navigation switches are known for diverse applications. They are generally used to control electronic appliances in consumer electronics, such as in digital cameras, video recorders or mobile telephones or else for menu control in electronic data processing appliances. In particular, they are used for reducing the components when individual components are assigned a plurality of functions.

To operate the switching element, the operating element has a tappet situated on its underside so that it is possible to make mechanical contact with the operating arm of the switching element. When the operating element is operated, the tappet on the operating element transfers the operating force to the operating arm of the switching element, so that the latter reaches a contact position and switches an electrical contact.

The navigation switches described in the outset have no protection against excessive operating forces at the present time. Improper or excessively heavy operation of the operating element produces a large operating force on the operating arm of the switching element which can result in destruction of the switching element. In addition, an undefined tilting movement of the operating element can result in destruction of the switching element.

SUMMARY OF THE INVENTION

It is an object of the invention to provide a navigation switch in which the switching element has better protection against premature wear and destruction.

The invention achieves the object by virtue of the operating element and the housing having a limiting element arranged between them which limits the operating forces on the switching element.

This navigation switch has the advantage that the use of a limiting element between the operating element and the housing which holds the operating element allows any type of switching elements to be protected against improper or excessively heavy operation.

The fact that the limiting element has a centrally provided cutout which corresponds to the dimensions of a tappet on the operating element allows the operating element to be guided in tracks and therefore prevents undefined tilting.

Excessively large operating forces are routed into the side walls of the housing which holds the limiting element by way of the limiting element. The tappet on the operating element can be securely guided on the operating arm of the switching element.

In one advantageous development, the limiting element is in the form of an integral part of the housing, and the limiting element and the housing are made of an elastomeric plastic.

In addition, one advantageous refinement provides for the limiting element to be convex relative to the operating element and to have a latticed structure.

Similarly, the limiting element may also be in the form of a curved plate made of plastic or metal.

In this context, it is beneficial for the limiting element to have an axial cutout for holding a tappet located on the underside of the operating element.

In one preferred form of the invention, the housing holding the limiting element encloses a circular cavity, with the outer region of the base which limits the cavity containing at least two latches, and the convex limiting element has at least two further mating latches which engage in the matching latches on the housing.

In this context, the limiting element is inserted into the cavity in the housing, and following assembly the limiting element is rotated clockwise through 45 degrees in order to latch it, so that the mating latches on the limiting element engage in the latches on the housing.

The invention makes it possible to employ very little production and assembly complexity to provide a navigation switch in which wear occurring under normal circumstances on account of excessively great operating forces is prevented by means of a limiting element. The modular unit of the housing for holding the operating element can be mounted and handled in preassembled form, without the need to use particular care.

Large operating forces arising on the operating element are routed into the side walls of the housing by means of the additional limiting element. The use of limiting elements allows microswitches, too, to be protected against improper or excessively heavy operation. At the same time, the limiting element allows the operating element to be guided in tracks in order to prevent undefined tilting.

The use of the optionally useable limiting element allows the properties to be aligned regardless of the material of the housing. The useful life of the navigation switch or of the switching element is influenced positively.

BRIEF DESCRIPTION OF THE SEVERAL VIEWS OF THE DRAWINGS

The invention is explained in more detail below using exemplary embodiments which are shown in the figures. Elements which are identical or which correspond to one another in different figures are provided with the same reference symbols.

In the figures:

FIG. 1 shows a perspective exploded illustration of a navigation switch based on the invention, FIG. 2 shows the plan view of the navigation switch shown in FIG. 1, FIG. 3 shows a vertical section D-D from FIG. 2, FIG. 4 shows a perspective illustration from obliquely above of a housing (holding the operating element) with an integrated limiting element, FIG. 5 shows the plan view of the housing shown in FIG. 4, FIG. 6 shows the horizontal section A-A through the housing shown in FIG. 5, FIG. 7 shows the vertical section B-B through the housing shown in FIG. 5, FIG. 10 shows the vertical section C-C through the navigation switch shown in FIG. 9, FIG. 11 shows a perspective illustration from obliquely above of the housing which holds the operating element, FIG. 12 shows a plan view of the housing shown in FIG. 11, FIG. 13 shows the vertical section A-A through the housing shown in FIG. 12, FIG. 14 shows a diagonal section B-B through the housing shown in FIG. 12, FIG. 15 shows the plan view of the limiting element of the inventive navigation switch shown in FIG. 8, FIG. 16 shows the section A-A from FIG. 15, and FIG. 17 shows a side view of the limiting element shown in FIG. 15.

DETAILED DESCRIPTION OF THE INVENTION

Figure 8:
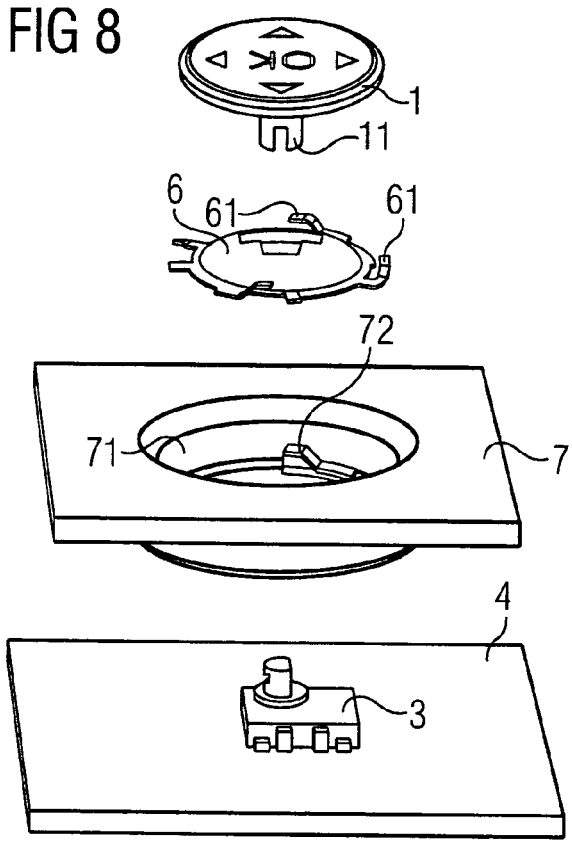
FIG. 8 shows a perspective exploded illustration of a further navigation switch based on the invention.

FIG. 1 shows the perspective illustration of a navigation switch based on the invention. The navigation switch has a switching element 3 with a square base area, said switching element being arranged on a housing part or on a board 4, for example. The switching element 3 has an operating arm 32 which is routed through a cutout in the cover of the switching element 3 and which serves as an axial extension to a switching lever (not shown here) arranged in the interior of the switching element 3. The switching lever arranged centrally in the interior of the switching element 3 can be moved against at least two contact regions, so that upon movement into a contact position an electrical contact is switched.

In addition, the navigation switch has a circular operating element 1 having four radially and one centrally arranged switching positions. The underside of the operating element 1 carries a tappet 11 arranged in the axial direction. In addition, the navigation switch has a housing 2 with a circular cavity 21 which corresponds to the dimensions of the operating element 1. In the assembled state, the operating element 1 is held by the housing 2, and the housing 2 is arranged above the switching element 3, so that the tappet 11 on the operating element 1 engages centrically in the operating arm 31 of the switching element 3.

The switching element 3 is operated by means of the operating element 1, with the tappet 11 on the operating element 1 transferring the operating forces to the operating arm 31 of the switching element 3, so that the operating arm 31 is moved into a switching position. In this context, a limiting element 5 arranged in the housing 2 limits the forces acting on the operating arm 31 of the switching element 3.

FIG. 2 shows the plan view of the navigation switch described in FIG. 1 with the operating element 1 arranged centrally in the housing 2.

The section D-D from FIG. 2 is shown in FIG. 3. As already discussed previously, the operating element 1 can be found in the housing 2, with the tappet 11 on the operating element 1 engaging around the operating arm 31 of the switching element 3. In the base region within the cavity 21 in the housing 2, there is an integrally molded limiting element 5 arranged convexly relative to the operating element 1.

As can be seen in detail from the perspective illustration of the limiting element 5 in FIG. 4 and from the plan view of the housing 2 with an integrated limiting element 5 in FIG. 6, the limiting element 5 has a central cutout 53 which corresponds to the external dimensions of the tappet 11 on the control element 1. It can also be seen that the limiting element 5 has a latticed structure, with the limiting element 5 in the advantageous refinement shown in FIG. 5 having spurs 52 which oppose one another in pairs parallel to the lateral and longitudinal axes of the limiting element 5 starting from the square collar 51 provided centrally with the cutout, the end of said spurs being integrally molded on the housing.

In this embodiment shown, the limiting element 5 is preferably made from an elastomeric plastic, for example, as an integral part of the housing 2.

FIGS. 6 and 7 respectively show the horizontal section A-A and the vertical section B-B from FIG. 5. The convexly curved limiting element is molded to the housing in a manufacturing process.

FIG. 8 shows a further advantageous refinement of the inventive navigation switch. In this case, a separate limiting element 6 is provided which is inserted into the base of a housing 7.

Figure 9:
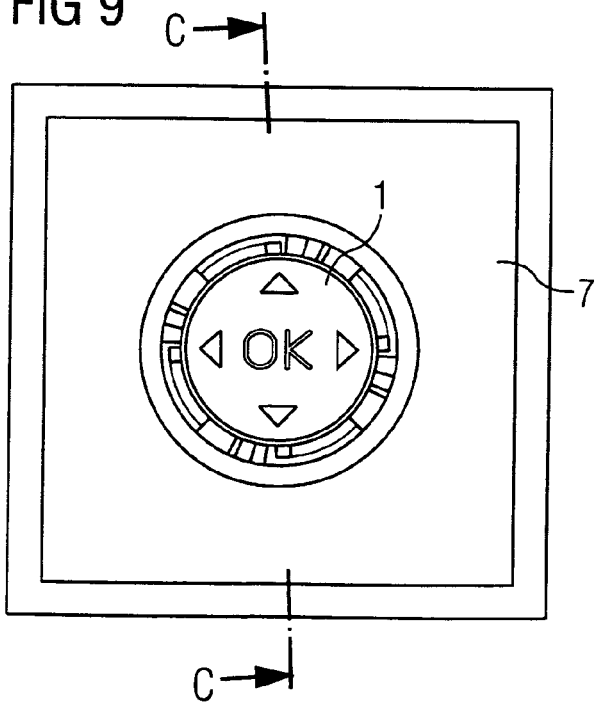
FIG. 9 shows the plan view of the navigation switch shown in FIG. 8.

FIG. 9 shows the plan view of the navigation switch described in FIG. 8 with the operating element 1 arranged centrally in the housing 7.

FIGS. 11 to 14 show various perspective views of the housing 7 holding the operating element 1. The housing 7 encloses a circular cavity 71 and has, on its base, as can be seen in detail from FIGS. 11 to 14, four latches 72 arranged radially on the side walls of the cavity 71.

FIGS. 15 to 17 show an embodiment of the limiting element 6. The limiting element 6 is in the form of a convexly curved plate with four mating latches 61 which are arranged at a lateral edge 62 and which are arranged radially at the same distance.

The limiting element 6 has a central cutout 63 which corresponds to the dimensions of the tappet 11 on the operating element 1. The tappet 11 on the operating element 1 runs through this cutout, so that secure guidance of the tappet 11 is made possible and hence uncontrolled operation of the operating arm 31 is prevented.

For the purposes of latching, the operating element 6 is rotated clockwise through 45 degrees and is thus firmly connected to the housing 7.

The particular mode of action of the limiting elements 5 and 6 can be seen from the sectional illustrations in FIGS. 3 and 10.

In the assembled state, the underside of the operating element 1 is at a minimum distance d from the top 54, 64 (see FIG. 3 and FIG. 10) of the limiting elements 5, 6 located in the housing 2, 7. A force f can be introduced onto the operating element 1 centrically or eccentrically. As can be seen from FIG. 10, in particular, the result of centric introduction of force f is that the control element 1 displaces the operating arm 31 of the switching element 3 downward into the switching element 3 through the path e. The path e represents a movement limitation provided by the limiting elements 5 and 6. In addition, the operating elements 5 and 6 limit tilting when a force is introduced eccentrically, on account of the distance d of the operating element 1 from the top 54, 64 of the limiting element 5, 6. In the event of excessive centric or eccentric introduction of force f, the compressive force on the operating element 1 is dissipated into the walls of the housing 2 and 7.

The invention claimed is:

1. A navigation switch comprising:

an operating element arranged to be tilted in at least two directions and arranged to be used to operate the navigation switch, the operating element having an underside, a housing arranged to hold the operating element, the housing including a cavity, a switching element arranged to be acted upon by the operating element, and a limiting element which limits operating forces on the switching element, wherein:

the limiting element has a top that is convex relative to the operating element, the limiting element is positioned within the cavity of the housing, the underside of the operating element is spaced at a distance from the top of the limiting element so that the limiting element limits tilting when a force is introduced eccentrically to the operating element.

2. The navigation switch according to claim 1, wherein the limiting element is integral with the housing.

3. The navigation switch according to claim 1, wherein the limiting element and the housing comprise elastomeric plastic.

4. The navigation switch according to claim 1, wherein the limiting element comprises a lattice.

5. The navigation switch according to claim 1, wherein the limiting element comprises a curved plate.

6. The navigation switch according to claim 5, wherein the limiting element comprises one of plastic and metal.

7. The navigation switch according to claim 1, wherein the limiting element comprises an axial cutout for holding a tappet located on an underside of the operating element.

8. The navigation switch according to claim 1, wherein:

the circular cavity is enclosed within an outer region of a base, the outer region of the base comprising at least two latches, and the limiting element comprises at least two further mating latches arranged to engage the matching latches on the housing.

9. The navigation switch to according to claim 8, wherein the limiting element is arranged to be inserted into the cavity in the housing, with the limiting element being rotated clockwise through 45° in order to latch it, so that the mating latches on the limiting element engage in the latches on the housing.

10. The navigation switch to according claim 1, wherein:

the switching element has an operating arm, the operating element displaces the operating arm into the switching element by a path when a force is introduced centrally, and the path is limited in movement by the limiting element.

* * * * *